US009352917B2

(12) United States Patent
Gerber

(10) Patent No.: US 9,352,917 B2
(45) Date of Patent: May 31, 2016

(54) METHOD FOR REMOVING A SUBSTANTIALLY PLANAR WORK PIECE FROM THE TOP OF A STACK OF WORK PIECES

(75) Inventor: Markus Gerber, Niederoenz (CH)

(73) Assignee: GUEDEL GROUP AG, Langenthal (CH)

( * ) Notice: Subject to any disclaimer, the term of this patent is extended or adjusted under 35 U.S.C. 154(b) by 0 days.

(21) Appl. No.: 14/409,795

(22) PCT Filed: Jun. 22, 2012

(86) PCT No.: PCT/CH2012/000137

§ 371 (c)(1),
(2), (4) Date: Jan. 16, 2015

(87) PCT Pub. No.: WO2013/188987

PCT Pub. Date: Dec. 27, 2013

(65) Prior Publication Data

US 2015/0197404 A1 Jul. 16, 2015

(51) Int. Cl.
*B65H 5/10* (2006.01)
*B21D 43/24* (2006.01)
(Continued)

(52) U.S. Cl.
CPC *B65H 5/10* (2013.01); *B21D 43/24* (2013.01); *B65H 3/0816* (2013.01);
(Continued)

(58) Field of Classification Search
CPC .. B65H 3/0808; B65H 3/0816; B65H 3/0833; B65H 3/0841; B65H 3/0883; B65H 3/14; B65H 3/48; B65H 3/50; B65H 3/56; B65H 3/60; B65H 3/64; B65H 2301/44336; B65H 2405/50; B65H 2405/51; B65H 2405/52; B65H 2405/55; B65H 2405/552; B65H 2405/5521; B65H 2406/34; B65H 2406/341; B65H 2406/342; B65H 2406/364
See application file for complete search history.

(56) References Cited

U.S. PATENT DOCUMENTS 4,470,589 A * 9/1984 Singer ..... 271/11
5,092,578 A * 3/1992 Bergmeier et al. ..... 271/97
(Continued)

FOREIGN PATENT DOCUMENTS

CN 1809504 A 7/2006
CN 1814528 A 8/2006
(Continued)

OTHER PUBLICATIONS

Chinese Office Action dated Sep. 20, 2015 issued in corresponding Chinese Application No. 201280074151.0 with an English Translation.
(Continued)

*Primary Examiner* — Ernesto Suarez
(74) *Attorney, Agent, or Firm* — Birch, Stewart, Kolasch & Birch, LLP

(57) ABSTRACT

A method for removing a substantially planar work piece (11) from the top of a stack (10) of work pieces comprises the steps of gripping the work piece (11) on a top surface of the work piece, lifting the gripped work piece, pre-separating the work piece from the stack by introducing a separator element (43) in between the lifted work piece and a neighboring work piece underneath the lifted work piece (11) and gripping and removing the pre-separated work piece (11) by a transport device. An apparatus for carrying out the method comprises a gripper (33) for gripping the work piece (11), the gripper (33) being movable in a vertical direction for lifting the gripped work piece (11), a separator element (43) being movable in a horizontal direction to be introduced in between the lifted work piece (11) and a neighboring work piece underneath the lifted work piece (11) and a transport device for gripping and removing the pre-separated work piece (11). The method and apparatus allow for fast and reliable removal of substantially planar work pieces from the top of a stack.

11 Claims, 4 Drawing Sheets

(51) Int. Cl.

| | |
|---|---|
| ***B65H 3/48*** | (2006.01) |
| ***B65H 3/08*** | (2006.01) |
| ***B65H 3/50*** | (2006.01) |
| ***B65H 5/14*** | (2006.01) |

(52) U.S. Cl.

CPC ..... *B65H 3/0833* (2013.01); *B65H 3/48* (2013.01); *B65H 3/50* (2013.01); *B65H 5/14* (2013.01); *B65H 2701/173* (2013.01)

(56) References Cited

U.S. PATENT DOCUMENTS

| | | | | |
|---|---|---|---|---|
| 5,290,023 | A * | 3/1994 | Sasaki et al. | 271/20 |
| 5,542,658 | A * | 8/1996 | Wirz et al. | 271/107 |
| 2006/0170146 | A1 * | 8/2006 | Kato | 271/97 |

FOREIGN PATENT DOCUMENTS

| | | | | |
|---|---|---|---|---|
| DE | 671 402 | C | | 2/1939 |
| DE | 31 36 544 | A1 | | 3/1983 |
| DE | 33 12 459 | A1 | | 10/1984 |
| DE | 10 2005 062 713 | A1 | | 7/2007 |
| EP | 0 173 613 | A1 | | 3/1986 |
| EP | 2653419 | A1 | * | 10/2013 |
| JP | H04-22431 | U | | 2/1992 |
| JP | 04-094830 | A | | 3/1992 |
| JP | 11-232421 | A | | 8/1999 |
| JP | 2002-211776 | A | | 7/2002 |
| SU | 776974 | A1 | | 7/1980 |

OTHER PUBLICATIONS

Japanese Office Action dated Apr. 12, 2016 issued in corresponding JP Application No. 2015-517569 with an English translation.

* cited by examiner

METHOD FOR REMOVING A SUBSTANTIALLY PLANAR WORK PIECE FROM THE TOP OF A STACK OF WORK PIECES

TECHNICAL FIELD

The invention relates to a method for removing a substantially planar work piece from the top of a stack of work pieces. It further relates to an apparatus for removing a substantially planar work piece from the top of a stack of work pieces.

BACKGROUND ART

In many applications, substantially planar work pieces, such as e.g. metal sheets, need to be removed one by one from a stack of work pieces. Corresponding methods and devices allowing for automatic removal and feeding e.g. to a processing station, are known. Often, these devices seize the top work piece from the stack by suitable grippers, e.g. magnetic elements or suction cups, and transport it to a desired location by moving the grippers together with the seized work piece.

One of the applications where corresponding devices are used is the processing of metal sheets in order to manufacture car body parts. Large-sized metal sheets are punched and shaped to obtain the desired geometry, in particular in a multi-stage press or press line. Prior to processing, a feeder seizes the top work piece of a stack and feeds it to the first processing station, which may be the head press but also stations for pre-processing such as de-greasing, cleaning, etc.

Removing the top sheet—and only the top sheet—from the stack is difficult: Often, neighboring sheets adhere to each other, e.g. because of coatings of the sheets (such as an oil film), which leads to sticking together of two or more sheets. However, if more than one sheet is seized and fed to the downstream process line, this may lead to severe damage up to destruction of a press tool. Current demands regarding processing speed make de-stacking even more challenging.

Several methods and devices for automatic destacking are known from the prior art. As an example, German patent No. 671 402 (Schuler) relates to an automatic apparatus for lifting and feeding strips to high speed presses, punching machines or similar. The strips are lifted from a stack and fed to a pincing feeder. A stop for the strip is arranged below the pincer neighboring the stack. Between the stop and the downstream edge of the stack, a lifting device is arranged for lifting the downstream end of the strip to the transport plane of the pincer. A suction device is arranged close to the upstream end of the stack. It is used for partially detaching the strip from the stack and may also be used for feeding the strip to the pincing feeder. Alternatively, there may be a separate feeding device for that purpose.

DE 33 12 459 A1 (Lewecke Maschinenbau) relates to a method for separating planar work pieces, such as flake boards, adhering to each other, when the topmost work piece is to be lifted by a suction gripper. For that purpose, pressurized air is directed into the gaps between adjacent workpieces. Furthermore, the separation process is supported by jerky accelerations and decelerations of the lifting movement.

DE 10 2005 062 713 A1 (Holzma Plattenaufteiltechnik) discloses a device for separating and removing a partial stack comprising at least one extended sheet from a remaining stack. The device includes an air nozzle which may be directed to the region of a separating plane below the lowest sheet of the partial stack. It may further include a separating element which may be introduced into a gap produced by the action of the air nozzle, in order to mechanically securing the gap and enlarging it, if required. In a further step, the partial stack is removed by means of a transport device comprising a transport bar and tongs.

Still, the known devices have drawbacks when removing extended and comparably heavy sheets, especially when a high throughput is required. The additional steps for improving the separation make the removal process more complicated and time-consuming.

SUMMARY OF THE INVENTION

It is the object of the invention to create a method and a device pertaining to the technical field initially mentioned, that allow for fast and reliable removal of substantially planar work pieces from the top of a stack.

The solution of the invention is specified by the features of claims 1 and 8. According to the invention, the method comprises the step of a) gripping the work piece on a top surface of the work piece;
b) lifting the gripped work piece;
c) pre-separating the work piece from the stack by introducing a separator element in between the lifted work piece and a neighboring work piece underneath the lifted work piece;
d) gripping and removing the pre-separated work piece by a transport device.

Correspondingly, the device according to the invention comprises a) a gripper for gripping the work piece on a top surface of the work piece, the gripper being movable in a vertical direction for lifting the gripped work piece;
b) a separator element being movable in a horizontal direction to be introduced in between the lifted work piece and a neighboring work piece underneath the lifted work piece for pre-separating the work piece from the stack;
c) a transport device for gripping and removing the pre-separated work piece.

It is to be noted that it is not required that the gripper lifts the work piece in such a way that it loses contact with the rest of the stack over its entire surface, but that lifting the work piece should be at least such that the separator element may be introduced in between the lifted work piece and the neighboring work piece. Furthermore, the possible movement of the gripper should have a vertical component allowing for lifting the gripped work piece in the way described before, it is not required that the gripper is movable along a (straight) vertical path. Similarly, the possible movement of the separator element should have a horizontal component allowing for introducing the separator element in between the two mentioned work pieces, it is not required that the separator element is movable along a (straight) horizontal path.

The invention allows for a pre-separation of the topmost work piece from the stack of work pieces, prior to actually removing the work piece by the transport device. The transport device grips the pre-separated work piece, which allows for seizing the work piece by the transport device in a much faster way than in cases where the work piece has to be separated in the context of being seized by the actual transport device. Pre-separation is largely independent from the activity of the transport device or downstream processing stations, with the only constraint that pre-separation has to be completed when the transport device approaches the work piece. Correspondingly, there is more time available for the entire separation process while at the same time the achievable speed of removing the work piece by the transport device is increased.

The gripper gripping the work piece on a top surface avoids the need for contacting the stack along its sides, which may require complicated controlling of the respective elements and may interfere with further elements of the system.

Accordingly, the invention allows at the same time for better reliability as well as for higher throughput of the removal process. In fact the method and apparatus according to the invention are particularly suited for the handling of metal sheets having sizes between 500×500 mm and 4500×2200 mm, at processing rates of 12/min or higher.

Preferably therefore, in the context of the inventive method, the steps of gripping and lifting the work piece and introducing the separator element are effected during removal and/or feeding of the preceding work piece by the transport device.

The inventive apparatus and method are particularly suitable for the removal of non-ferromagnetic metal sheets, such as aluminium sheets. These sheets tend to adhere to each other, at the same time most magnetic units will not be applicable for separating or even gripping the sheets.

Accordingly, a preferred embodiment of the inventive apparatus has a gripper comprising a suction system for gripping the top surface of the work piece. The suction system allows for gripping non-ferromagnetic metal sheets or other work pieces by just contacting their top surface. They are easy to implement and cost-efficient. Furthermore, the work pieces may be rapidly and easily released by switching off the vacuum applied to the suction system.

Instead of a suction system (or in addition thereto) elements based on other effects may be employed, such as magnetic grippers (for work pieces made from a ferro-magnetic material) or mechanical grippers (especially if the work pieces comprise suitable structures on their top surface, which allow for the application of mechanical grippers).

In a preferred embodiment, the separator element comprises an injector for feeding pressurized gas in between the lifted work piece and the neighboring work piece. Pressurized air is preferred as it is easily available.

The feeding of pressurized gas may support the separation of the neighboring work pieces, especially in regions where separation has not been accomplished by the actions of the gripper. It may also prohibit that the work pieces—once separated—adhere to each other again, especially during the seizure of the top work piece by the transport device.

Pressurized gas may be feed prior and during the introduction of the separator element in between the work pieces and/or after it has been fully introduced, i.e. reached its end position between the work pieces.

Preferably, the separator element comprises a separator panel and an injection nozzle arranged below the separator panel. The separator panel is formed in such a way that it guides gas ejected through the nozzle in between the lifted work piece and the neighboring work piece. This means that, generally, the mouth of the nozzle will be set back with respect to the front end of the separator panel. The separator panel being introduced in between the work pieces and having a generally flat form (the main surface of the panel being in particular parallel to the main surfaces of the work pieces of the stack) is well suited for guiding the gas stream. Depending on the work pieces to be separated, suitably directing the pressurized gas may be crucial for a reliable separation. Furthermore, additional guide elements may be dispensed of, the separator panel has a double function of mechanically supporting the lifted work piece and guiding the gas stream.

Alternatively, the injection nozzle may be arranged differently, e.g. at the front end of the separator element or above the separator element.

Preferably, the work piece is gripped in a region close to an edge of the work piece. Furthermore, the separator element is introduced in between the work pieces in this region. This allows for a simple construction of the apparatus, generates maximum separation forces along the respective edge and ensures that the separator element can be introduced in between the work pieces.

Accordingly, it is preferred to have a plurality of grippers and separator elements being arranged along a lateral edge of the work piece. The plurality of grippers and separator elements ensure that even large work pieces are reliably separated and kept separated in a large part thereof. Arranging the grippers and separator elements along a lateral edge keeps the back end and the front end of the stack free, which facilitates feeding and removal of work pieces to or from the stack, respectively. It is to be noted, that in the context of this preferred embodiment the invention requires to have grippers and separator elements only along one of the lateral edges, i.e. the opposing lateral edge is as well accessible, if required.

The plurality of grippers and separator elements may have separate drives, actuators, guides and controllers or may share some or all of these components.

Still, it is possible to have grippers acting on a region distant from any of the edges of the work piece. Grippers may also be arranged along a plurality of lateral and/or cross edges of the work piece.

Preferably, the gripper is removed after having introduced the separator element and prior to approach of the gripping elements of the transport device. Similarly, advantageously the work piece is gripped by the transport device when it is at least partially supported by the separator element.

The separation is upheld due to the separator element, therefore the gripper is not required anymore for that purpose. Removing the gripper exposes the entire top surface of the work piece, which means that substantially any available transport device may grip and remove the work piece, with maximum speed. Special solutions are not required.

Advantageously, the gripper and the separator element are arranged on the same unit. This allows for a simple construction and installation of the inventive apparatus. Furthermore, some of the required movements, such as a horizontal movement along a working direction, that are required for both the gripper and the separator element may be actuated by a common element.

In the context of that embodiment, it is preferred that the unit comprises a first carriage carrying the gripper, the first carriage being movable along a horizontal working direction and a second carriage carrying the separator element, the second carriage being movable along the working direction, whereas the movements of the two carriages are substantially independent from each other. Furthermore, the gripper is movable in a substantially vertical direction with respect to the first carriage. This allows for implementing all the required degrees of freedom in a simple, reliable and cost-efficient way.

Furthermore, it is advantageous to have a working direction that is perpendicular to a transport direction of the transport device. In that case, the unit is arranged sideways of the work pieces and the working direction runs perpendicular to the lateral edge facing the unit(s).

Alternatively, the gripper and the separator are separate entities with separate mountings and separate drives.

Other advantageous embodiments and combinations of features come out from the detailed description below and the totality of the claims.

BRIEF DESCRIPTION OF THE DRAWINGS

The drawings used to explain the embodiments show.

In the figures, the same components are given the same reference symbols.

PREFERRED EMBODIMENTS

Figure 1:
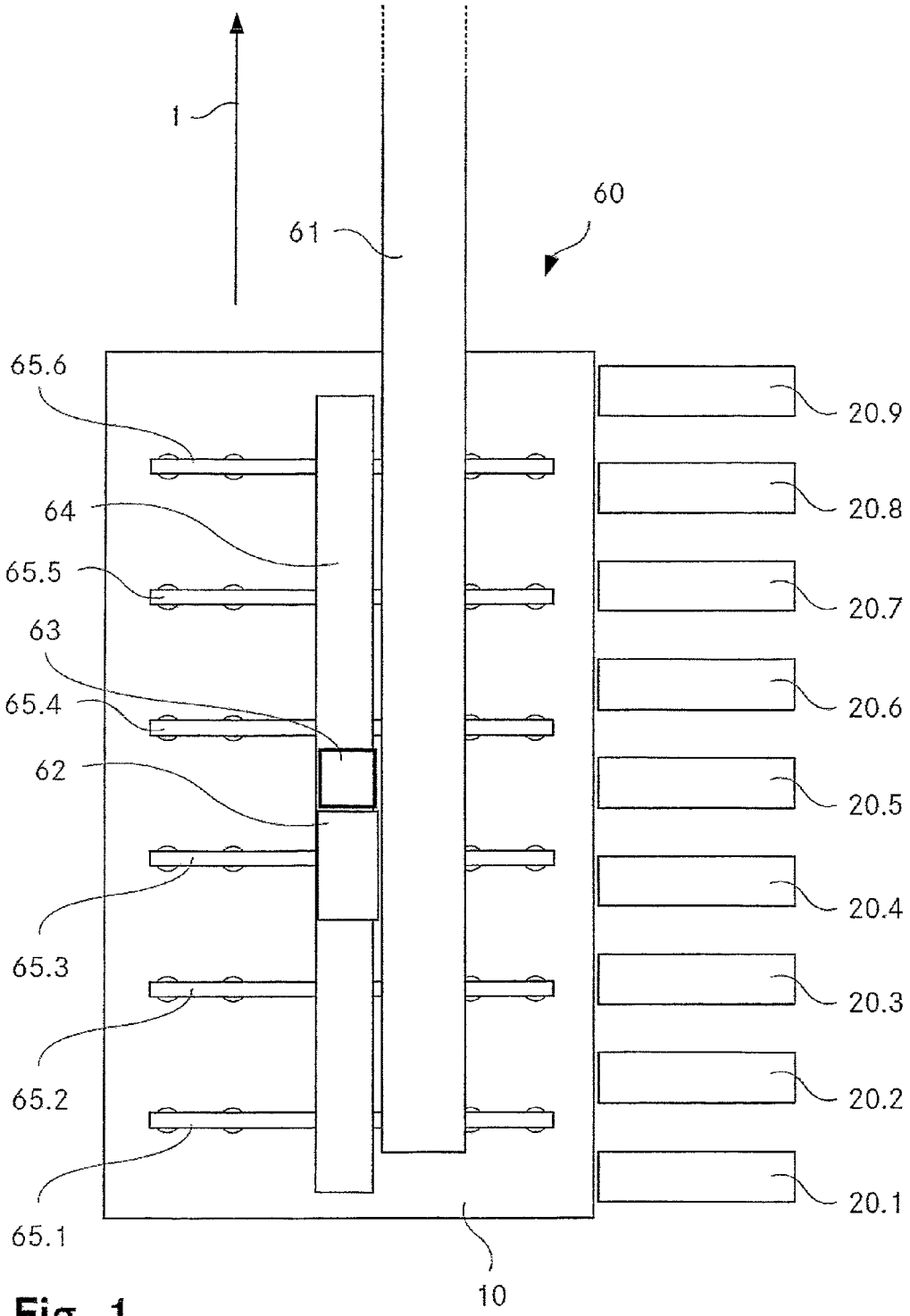
FIG. 1 a schematic top view of an inventive apparatus.

FIG. 1 is a schematic top view of an inventive apparatus. Along one of the lateral edges of a stack 10 of planar work pieces having a rectangular foot print (e.g. sheet metal plates) nine devices 20.1 . . . 20.9 for pre-separating the topmost work piece are arranged. The devices 20.1 . . . 20.9 have equal distance from each other and cover essentially the whole length of the stack. A horizontal guide rail 61 of a transport device 60 is arranged above the stack 10, extending in the longitudinal direction of the stack 10. A main carriage 62 is supported on the guide rail 61, it is movable along the guide rail 61 by a suitable drive mechanism. A secondary carriage 63 is supported on the main carriage 62 in such a way that it is vertically movable with respect to the main carriage 62. A longitudinal beam 64 is attached to the bottom end of the secondary carriage 63. On its lower side, the longitudinal beam 64 carries six cross-beams 65.1 . . . 65.6, each of them being equipped with four suction cups 66 connected to a vacuum system (not shown).

On one end, the guide rail 61 extends over the stack 10 such that work pieces seized by the transport mechanism 60 may be transported along the guide rail 61 in the transport direction 1 to a subsequent station, i.e. the first station of a multiple-stage press. For that purpose, the main carriage 62 is moved along the guide rail 61 until the cross-beams 65.1 . . . 65.6 carried by the main carriage 62 are positioned over the stack 10. This is the situation shown in FIG. 1. The secondary carriage 63 is lowered with respect to the main carriage 62 until the suction cups 66 contact the topmost work piece. The vacuum source connected to the suction cups 66 is activated (this may be done prior to the contact of the suction cups 66 with the work piece) such that the work piece is seized. Subsequently, the cross-beams 65.1 . . . 65.6 with the suction cups 66 are lifted by accordingly lifting the secondary carriage 63. Finally, the seized work piece may be transported away by moving the main carriage 62 along the guide rail 61.

Transport devices 60 as shown in FIG. 1 are known from the prior art. Concerning that part of the inventive apparatus, it is therefore not required to provide a more detailed description. However, if substantially planar work pieces (such as aluminium sheets or similar) are to be removed from a stack in order to be transported away, there is usually the problem of sticking together of multiple sheets. The further components of the apparatus, namely the devices 20.1 . . . 20.9 for pre-separating the topmost work piece, aim at solving this problem. They are described in more detail in connection with FIGS. 2 and 3.

Figure 2A:
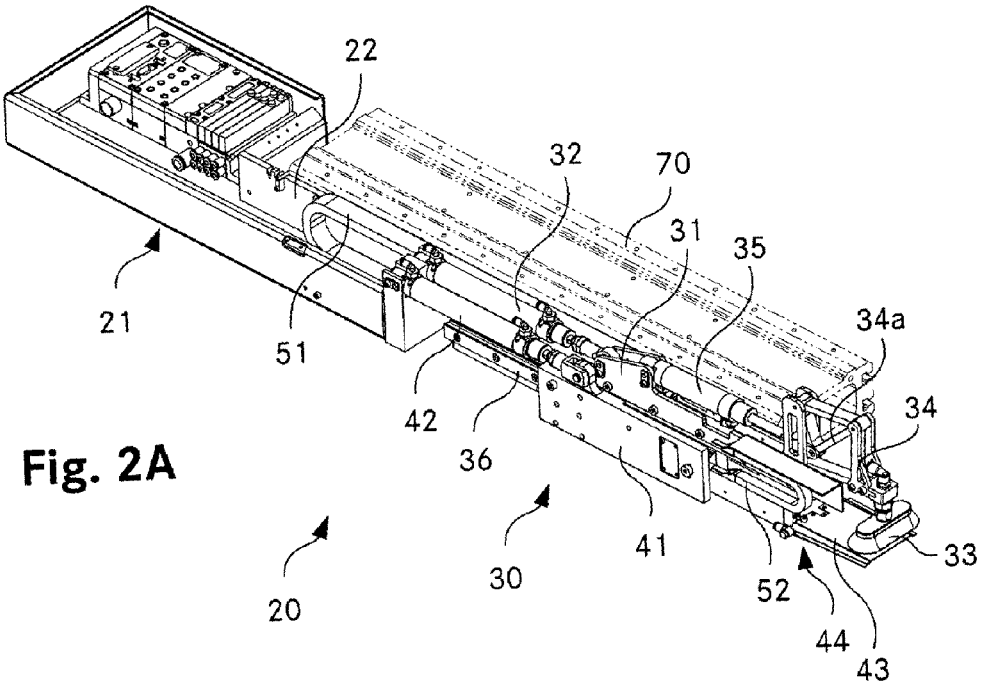
FIGS. 2A, B perspective views of an apparatus for removing a substantially planar work piece from the top of a stack of work pieces.
Figure 2B:
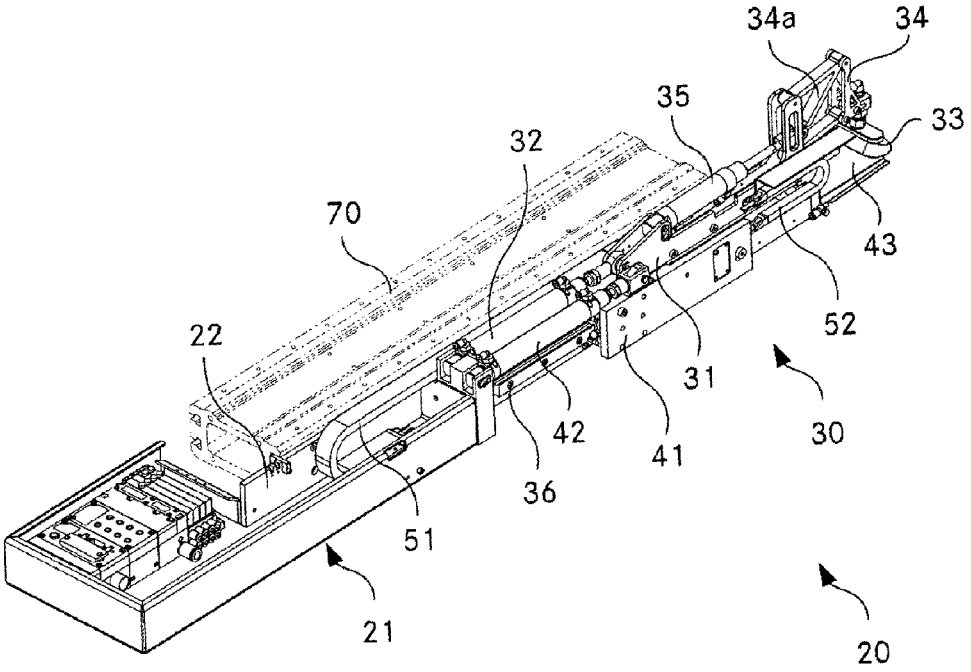

FIGS. 2A, 2B are perspective views of a device for pre-separating a substantially planar work piece from the top of a stack of work pieces. The device 20 is attached to a support beam 70 of the machine frame of the apparatus for removing the work pieces. The device 20 includes an L-shaped base part 21 housing circuitry, power supply and pneumatic components and an operation part 30. The support beam 70 runs in a horizontal plane, its longitudinal extension is perpendicular to the longitudinal edge of the stack of work pieces. The device 20 is attached to the support beam 70 in such a way that its operation part 30 is facing the stack.

In the situation shown in FIGS. 2A, 2B the operation part 30 is in its retracted position, i.e. the front end of the device 20 does not extend into the space above the stack of work pieces. Further positions of the mechanism are described further below, in connection with FIGS. 3B-3D.

The operation part 30 comprises a gripper carriage 31, which is movable relative to the base part 21, along the longitudinal extension of the device 20, i.e. perpendicular to the longitudinal edge of the stack. For that purpose, the gripper carriage 31 is supported on a first guide rail attached to a lateral panel 22 of the device 20 neighboring the support beam 70 of the machine frame. Linear movement of the gripper carriage 31 relative to the guide rail is actuated by a pneumatic cylinder 32 attached between the base part 21 and the rear end of the gripper carriage 31. A suction cup 33 is attached to a four-bar linkage 34 and actuated by a further pneumatic cylinder 35, the rear end of which being mounted to the gripper carriage 31, the front end of which controlling a control arm 34*a* of the four-bar linkage 34.

The operation part 30 further comprises a separator carriage 41, which is movable relative to the base part 21, along the longitudinal extension of the device 20, i.e. perpendicular to the longitudinal edge of the stack. For that purpose, the separator carriage 41 is supported on a second guide rail attached to the gripper carriage 31. Linear movement of the separator carriage 41 relative to the guide rail 36 is actuated by a pneumatic cylinder 42 attached between the base part 21 and the rear end of the separator carriage 41. A separator panel 43 is attached to the front end of the separator carriage 41. In cross-section, the separator panel has a central flat section and lateral sections including an inner region extending from the central section in an inclined direction as well as an outer region parallel to the central flat section of the separator panel 43. The width of the inner region of each lateral section decreases in the direction of the free end of the separator panel 43. Below the separator panel 43 an injection nozzle 44 is arranged at the front end of the separator carriage 41, along the middle axis of the separator panel 43 (see also FIG. 3).

The further pneumatic cylinder 35 of the gripper carriage 31 is attached to a pneumatic line and the suction cup 33 is attached to a further pneumatic line, both via a first energy chain 51 linking the gripper carriage 31 to the base part 21. The injection nozzle 44 is supplied with pressurized air via the first energy chain 51 and a second energy chain 52 linking the gripper carriage 31 to the separator carriage 41.

The FIGS. 3A-3G are side views of the sequence of steps of an inventive method for pre-separating a substantially planar work piece 11 from the top of a stack 10 of work pieces.

Figure 3A:
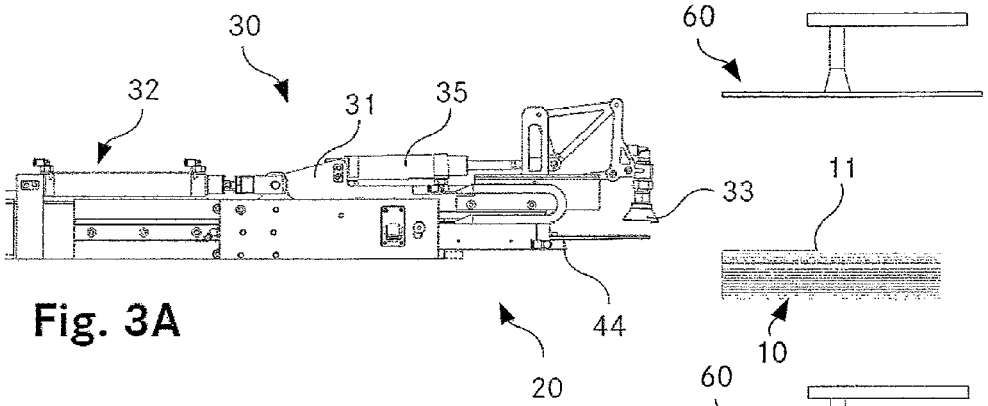
FIGS. 3A-G side views of the sequence of steps of an inventive method for pre-separating a substantially planar work piece from the top of a stack of work pieces.

FIG. 3A shows the situation depicted in the perspective views of FIGS. 2A, 2B, i.e. the operation part 30 is in its retracted position and the front end of the device 20 does not extend into the space above the stack 10 of work pieces.

Figure 3B:
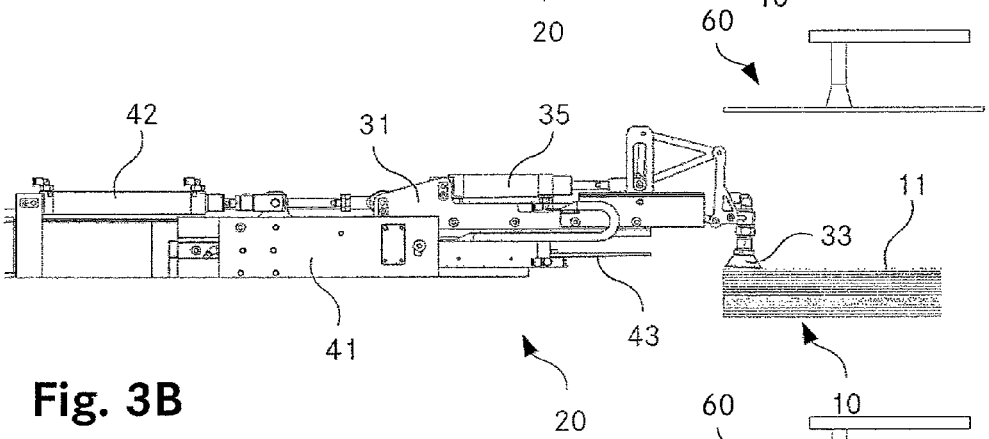

In order to pre-separate the topmost work piece 11 from the stack 10, the gripper carriage 31 is moved to its foremost position by actuating the pneumatic cylinder 32. Next, the suction cup 33 is lowered by actuating the further pneumatic cylinder 35 until the upper surface of the topmost work piece is contacted. The resulting situation is shown in FIG. 3B. This is when the vacuum is applied to the suction cup 33 by switching a corresponding valve in the base part 21 of the device 20.

Figure 3C:
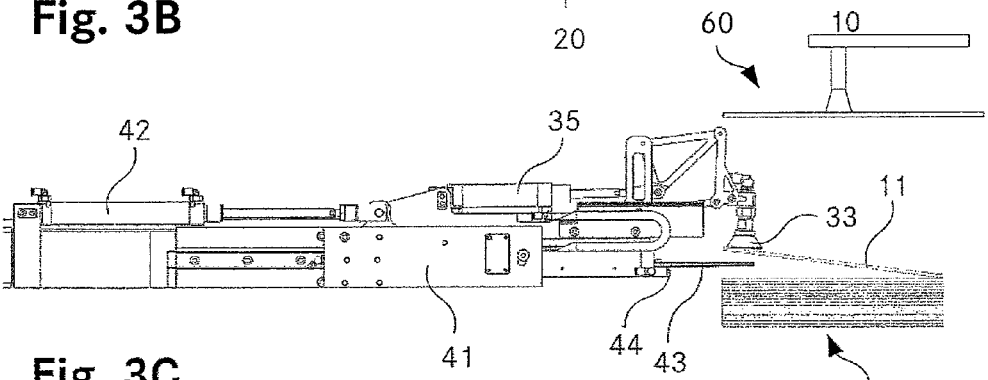

Next, the suction cup 33 is lifted by means of the pneumatic cylinder 35. Along the corresponding edge, the topmost work piece 11 lifted as well, creating a clearance between the topmost lifted work piece 11 and the second work piece of the stack 10. Then, the separator carriage 41 is moved to its foremost position by actuating the pneumatic cylinder 42, where the front part of the separator panel 43 extends into the clearance between the topmost lifted work piece 11 and the second work piece. The corresponding situation is shown in FIG. 3C.

Figure 3D:
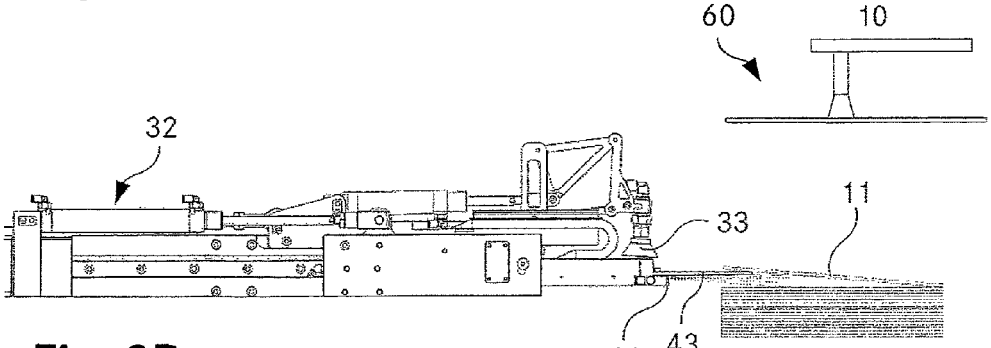
Figure 3E:
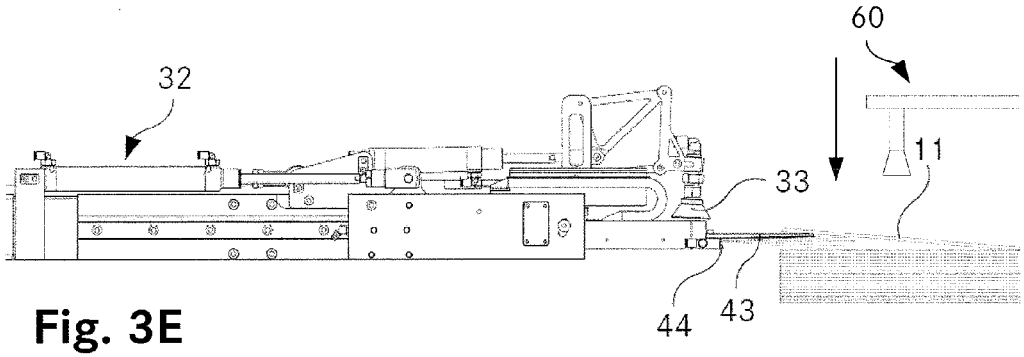
Figure 3F:
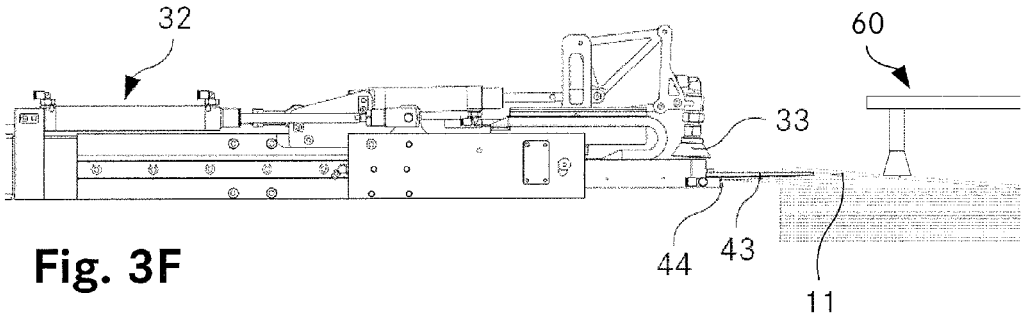
Figure 3G:
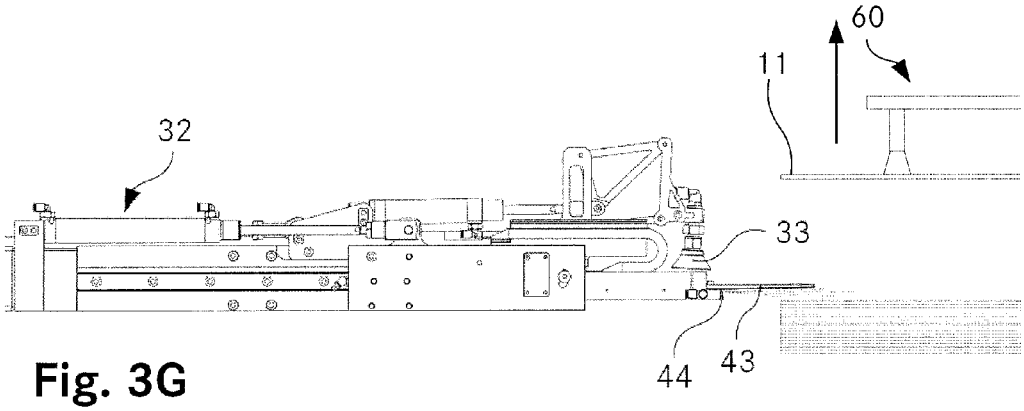

Next, air is injected into the clearance through the nozzle 44. Finally, the vacuum applied to the suction cup 33 is switched off. The topmost work piece 11 is deposited on the separator panel 43. Now, the gripper carriage 31 may be retracted to its back position, reaching the situation as shown in FIG. 3D. This situation in which the pre-separated topmost work piece is gripped and removed by a transport device 60 is shown in FIGS. 3E-3G. The mechanical separation by separation panel 43 and the air stream from nozzle 44 ensure that the topmost work piece may be easily lifted off. After removal of the work piece 11, the air stream is switched off. Subsequently, the separator carriage 41 is retracted, such that the situation shown in FIG. 3A is reached again.

Pre-separation happens in the time interval when the previous work piece has been fully removed from the stack of work pieces, prior to gripping and removing the next work piece by the transport device. Correspondingly, pre-separation will ease and speed up the removal of the work pieces without and additional time requirement.

The invention is not limited to the described embodiment. Various elements, in particular the mountings and actuators of the suction cup and the separator, may be embodied in other ways. Depending on the length of the work pieces to be removed, a single device or a smaller number of devices for pre-separating may suffice or more than nine devices are needed.

In summary, it is to be noted that the invention creates a method and a device for removing a substantially planar work piece from the top of a stack of work pieces, that allow for fast and reliable removal.

The invention claimed is:

1. A method for removing a substantially planar, non-ferromagnetic metal sheet from the top of a stack of metal sheets, comprising the steps of a) gripping the metal sheet on a top surface of the metal sheet, using a gripper;

b) lifting the gripped metal sheet;

c) pre-separating the metal sheet from the stack by introducing a separator element in between the lifted metal sheet and a neighboring metal sheet underneath the lifted work piece;

d) gripping and removing the pre-separated metal sheet by a transport device wherein the metal sheet is gripped by the transport device when it is at least partially supported by the separator element, wherein the gripper is removed from the metal sheet after having introduced the separator element and prior to the approach of gripping elements of the transport device toward the metal sheet; and e) wherein the steps of (a) gripping and (b) lifting the metal sheet and (c) introducing the separator element are performed during removal of a preceding metal sheet by the transport device.

2. The method as recited in claim 1, comprising the further step of feeding pressurized gas in between the lifted metal sheet and the neighboring work piece.

3. The method as recited in claim 1, wherein the metal sheet is gripped in a region close to an edge of the metal sheet, and in that the separator element is introduced in between the work pieces in this region.

4. An apparatus for removing a substantially planar, non-ferromagnetic metal sheet from the top of a stack of metal sheets, comprising:

a) a gripper for gripping the metal sheet on a top surface of the metal sheet, the gripper being movable in a vertical direction for lifting the gripped metal sheet;

b) a separator element being movable in a horizontal direction to be introduced in between the lifted metal sheet and a neighboring metal sheet underneath the lifted metal sheet for pre-separating the metal sheet from the stack;

c) a transport device comprising gripping elements for gripping and removing the pre-separated metal sheet when it is at least partially supported by the separator element; and d) a control unit configured to control the gripper, the separator element and the transport device, wherein the control unit removes the gripper from the metal sheet after having introduced the separator element between the metal sheets and prior to the approach of the gripping elements of the transport device toward the metal sheet, to at least partially support the pre-separated metal sheet by the separator element, wherein the metal sheet is gripped and lifted by the gripper and the separator element is introduced during removal of a preceding metal sheet by the transport device.

5. The apparatus as recited in claim 4, wherein the gripper comprises a suction system for gripping the top surface of the metal sheet.

6. The apparatus as recited in claim 4, wherein the separator element comprises an injector for feeding pressurized gas in between the lifted metal sheet and the neighboring metal sheet.

7. The apparatus as recited in claim 4, wherein the separator element comprises a separator panel and an injection nozzle arranged below the separator panel, whereas the separator panel is formed in such a way that it guides gas ejected through the nozzle in between the lifted metal sheet and the neighboring metal sheet.

8. The apparatus as recited in claim 4, wherein the gripper and the separator element are arranged on the same unit.

9. The apparatus as recited in claim 4, wherein the unit comprises a first carriage carrying the gripper, the first carriage being movable along a horizontal working direction and a second carriage carrying the separator element, the second carriage being movable along the working direction, independently from the first carriage, whereas the gripper is further movable in a substantially vertical direction with respect to the first carriage.

10. The apparatus as recited in claim 9, wherein the working direction is perpendicular to a transport direction of the transport device.

11. The apparatus as recited in claim 4 wherein a plurality of grippers and separator elements are arranged along a lateral edge of the metal sheet.

* * * * *